US007917258B2

(12) United States Patent
Goubault et al.

(10) Patent No.: US 7,917,258 B2
(45) Date of Patent: Mar. 29, 2011

(54) SHIP OF THE TYPE COMPRISING A CONTROL BRIDGE WITH A DIRECT VIEW OF THE ENVIRONMENT AND AN OPERATIONS CONTROL ROOM

(75) Inventors: Philippe Goubault, Lorient (FR); Yves Mervin, Lorient (FR); Claudia Bardes, Larmor Plage (FR)

(73) Assignee: DCN, Paris (FR)

( * ) Notice: Subject to any disclaimer, the term of this patent is extended or adjusted under 35 U.S.C. 154(b) by 933 days.

(21) Appl. No.: 11/783,013

(22) Filed: Apr. 5, 2007

(65) Prior Publication Data

US 2007/0244642 A1 Oct. 18, 2007

(30) Foreign Application Priority Data

Apr. 7, 2006 (FR) ..... 06 03120

(51) Int. Cl.
*B60L 3/00* (2006.01)
*B60L 15/00* (2006.01)

(52) U.S. Cl. ..... 701/21; 701/36; 359/725; 114/266; 348/222.1; 348/211.1; 348/121; 348/134

(58) Field of Classification Search ..... 701/23, 701/29.2, 21, 36, 300; 318/588; 340/944, 340/438; 348/122, 222.1, 121, 124, 211; 114/266; 472/60; 382/254
See application file for complete search history.

(56) References Cited

U.S. PATENT DOCUMENTS 4,371,343 A * 2/1983 Paris et al. ..... 434/29
5,307,074 A * 4/1994 Janex ..... 342/41
6,135,041 A * 10/2000 Hamata ..... 114/39.21
6,577,932 B1 * 6/2003 Van Beurden et al. ..... 701/21
7,036,449 B2 * 5/2006 Sutter ..... 114/264
7,047,114 B1 * 5/2006 Rogers ..... 701/21
7,729,819 B2 * 6/2010 Rajaram ..... 701/19
7,782,374 B2 * 8/2010 Suzuki et al. ..... 348/239
2004/0243859 A1 12/2004 Mueller et al.
2005/0114025 A1 * 5/2005 Brant et al. ..... 701/301
2005/0274312 A1 * 12/2005 Sutter ..... 114/264
2006/0030978 A1 * 2/2006 Rajaram ..... 701/19
2007/0244642 A1 * 10/2007 Goubault et al. ..... 701/300

FOREIGN PATENT DOCUMENTS

DE 2554972 * 6/1977
DE 2748328 A * 5/1979
DE 197 04 740 8/1998
EP 1842771 A1 * 10/2007
FR 1.600.832 9/1970

(Continued)

OTHER PUBLICATIONS

What's real about virtual reality?; Brooks, F.P., Jr.; Computer Graphics and Applications, IEEE; vol. 19, Issue 6, Nov.-Dec. 1999 pp. 16-27; Digital Object Identifier 10.1109/38.799723.*

(Continued)

*Primary Examiner* — Cuong H Nguyen
(74) *Attorney, Agent, or Firm* — Young & Thompson

(57) ABSTRACT

Ship (1) of the type comprising a control bridge (2) with a direct view of the ship's environment, and an operations control room (3) receiving information in real time on the situation of the environment of the ship, prepared by analysis means (4) for analysing the environment of the ship, of which the operations control room (3) comprises means for the panoramic display of the ship's environment.

17 Claims, 3 Drawing Sheets

FOREIGN PATENT DOCUMENTS

| | | | | |
|---|---|---|---|---|
| FR | 2334159 | | * | 7/1977 |
| FR | 2899559 | A1 | * | 10/2007 |
| GB | 1536318 | A | * | 12/1978 |
| NL | 7613551 | | * | 6/1977 |
| WO | WO 93/06511 | | | 4/1993 |
| WO | WO 00/15496 | | | 3/2000 |
| WO | WO 2009002202 | A2 | * | 12/2008 |

OTHER PUBLICATIONS

A proposal for an ocanographic vessel based upon experience and observation; Berman, C., Jr.; OCEANS; vol. 17, Nov. 1985 pp. 1168-1171.*

Multiple display viewing architecture for virtual environments over heterogeneous networks; Ferreira, A.G.; Cerqueira, R.F.G.; Celes, W.; Gattass, M.; Computer Graphics and Image Processing, 1999. Proceedings. XII Brazilian Symposium on, Oct. 17-20, 1999 pp. 83-92 ; Digital Object Identifier 10.1109/SIBGRA.1999.805713.*

Using Virtual Reality to Visualize Scientific, Engineering, and Medical Data; Lanzagorta, M.; Rosenblum, L.; Kuo, E.; Rosenberg, R.; Scientific Visualization Conference, 1997; 1997 pp. 161-161.*

Real-time data transmission between research vessel and shore command center; Creed, E.L.; Glenn, S.M.; OCEANS 2000 MTS/IEEE Conference and Exhibition; vol. 2; Digital Object Identifier: 10.1109/OCEANS.2000.881758 Publication Year: 2000 , pp. 1153-1157 vol. 2.*

Simulating test of ship navigation safety evaluation using ship handling simulator ; Zhang Xiufeng et al.; OCEANS, 2005. Proceedings of MTS/IEEE; Digital Object Identifier: 10.1109/OCEANS.2005.1640037; Publication Year: 2005 , pp. 1902-1905 vol. 2.*

Cognitive aspects of interface design and human-centered automation on the ship bridge: the example of ARPA/ECDIS integration; May, M.; Human Interfaces in Control Rooms, Cockpits and Command Centres, 1999. International Conference on Publication Year: 1999 , pp. 394-399.*

Next generation ECDIS for commercial and military uses; Pillich, B.; Schack, C.; OCEANS '02 MTS/IEEE; vol. 2 Digital Object Identifier: 10.1109/OCEANS.2002.1192108; Publication Year: 2002 , pp. 1025-1032 vol. 2.*

Integrated control and monitoring systems-a growing requirement; Marwood, C.T.; Control in the Marine Industry, IEE Colloquium on; Publication Year: 1988 , pp. 8/1-8/3.*

Development of a new Unmanned Semi-Submersible (USS) vehicle; Alleman, P.; Kleiner, A.; Steed, C.; Hook, D.; OCEANS 2009, MTS/IEEE Biloxi—Marine Technology for Our Future: Global and Local Challenges; Publication Year: 2009 , pp. 1-6.*

The Telesupervised Adaptive Ocean Sensor Fleet Architecture; Elfes, A.; Podnar, G.W.; Dolan, J.M.; Stancliff, S.; Lin, E.; Hosier, J.C.; Ames, T.J.; Higinbotham, J.; Moisan, J.R.; Moisan, T.A.; Kulczycki, E.A.; Aerospace Conference, 2008 IEEE Digital Object Identifier: 10.1109/AERO.2008.4526460 ; Publication Year: 2008 , pp. 1-9.*

ABS Naval Vessel Rules (NVR) for Mission Critical Networks, Software Development, and Safety Critical Control Systems Roa, M.; Electric Ship Technologies Symposium, 2007. ESTS '07. IEEE; Digital Object Identifier: 10.1109/ESTS.2007.372076 Publication Year: 2007 , pp. 138-144.*

Research of Navy Vessel Synergetic Design System Based on SBA; Jianwei Lv; Hai Zhou; Innovative Computing Information and Control, 2008. ICICIC '08. 3rd International Conference on; Digital Object Identifier: 10.1109/ICICIC.2008.450; Publication Year: 2008, pp. 299.*

Design of a resource advisor for the next-generation surface combatant; Weston, N.; Balestrini-Robinson, S.; Fulmer, D.D.; Mavris, D.N.; System Theory, 2006. SSST '06. Proceeding of the Thirty-Eighth Southeastern Symposium on Digital Object Identifier: 10.1109/SSST.2006.1619083; Publication Year: 2006 , pp. 176-180.*

New tools for ocean exploration, equipping the NOAA Ship Okeanos Explorer; Manley, J.E.; OCEANS 2008; Digital Object Identifier: 10.1109/OCEANS.2008.5151876; Publication Year: 2008 , pp. 1-5.*

* cited by examiner

SHIP OF THE TYPE COMPRISING A CONTROL BRIDGE WITH A DIRECT VIEW OF THE ENVIRONMENT AND AN OPERATIONS CONTROL ROOM

TECHNICAL FIELD

The present invention relates to a ship of the type comprising a control bridge with a direct view of the environment and an operations control room receiving information in real time about the situations of the ship's environment.

BACKGROUND TO THE INVENTION

Ships generally comprise control bridges which are situated in the superstructures and allow the officer responsible for control of the ship to see what is happening around the ship and to make the necessary decisions for controlling the ship. If these ships are military ships, they further comprise an operations control room which receives information in real time about the situation of the ship's environment in general and more particularly the tactical situation and this allows the officers responsible, in particular, for the ship's weapons system to make the necessary decisions and to transmit the required orders.

The operations control room is generally installed inside the ship in an area comprising means for analysing the ship's environment.

This arrangement has several drawbacks.

Firstly, the officers responsible for controlling the ship's weapons system are not in direct contact with the bridge and do not have a direct perception of the ship's environment.

The second drawback of this arrangement is that the means for analysing the ship's environment are limited to means which can be embarked on the actual ship. These means are limited by the capacity of the ship and by the nature and quantity of information available to it.

Furthermore, if the meteorological conditions are not favourable, direct viewing of the environment from the bridge is limited and the information provided by the supplementary means for perceiving the environment such as radar may be inadequate. These problems of inadequate perception of the ship's environment, which are particularly crucial in the case of military ships, can also arise in the case of civilian ships.

In addition, this arrangement necessitates the presence on each ship of specialised personnel who will increase the crew.

SUMMARY OF THE INVENTION

The object of the present invention is to overcome these drawbacks by proposing ship architecture to allow the team of officers controlling the ship to have a more direct perception of the ship's environment and optionally to allow them to have information which is more complete than that which the ship may have directly.

The invention accordingly relates to a ship of the type comprising a control bridge with a direct view of the ship's environment, and an operations control room receiving information in real time on the situation of the environment of the ship, prepared by analysis means for analysing the environment of the ship, wherein the operations control room comprises display means for the realistic panoramic display of the ship's environment.

The panoramic display means extend to the periphery of the operations control room and display in real time images of the ship's environment corresponding at least to what operators could see if they had a direct view of the environment.

The displayed images of the environment are prepared from images comprising images provided by viewing means for viewing in visible light.

The displayed images are prepared from images comprising images provided by viewing means with night vision.

The images from which the displayed images are prepared further comprise artificial images prepared from elements for analysing the ship's environment.

The artificial images are prepared in such a way as to allow identification and tracking of possible objects located in the ship's environment and, in particular, moving objects.

Preferably, the ship is for military use and identified objects are, in particular, aggressive objects.

It comprises viewing means and/or detection means, and processing means for preparing the images of the environment which are displayed in real time.

The display and/or detection means comprise at least one device taken from among a visible light camera with or without a light amplifier, an infrared camera, radar and sonar.

The operations control room further comprises display means for displaying the situation of the ship's environment prepared by the means for analysing the environment.

The means for displaying the situation of the ship's environment comprise a three-dimensional holographic display bubble.

The display means can be adapted to create screen zones which are shared between a plurality of operators.

The ship is for military use and in situation of the ship's environment is the tactical situation.

The operations control room comprises at least one direct access to the ship's bridge.

The control bridge allows a direct view around 360°.

The operations control room and at least some of the means for analysing the environment are separated.

Means for analysing the environment are situated outside the ship and communicate with the ship via telecommunications means.

Means for analysing the environment are situated on a different ship or in a coordination centre situated on land or in an aircraft.

BRIEF DESCRIPTION OF THE DRAWINGS

The invention will now be described in a more specific non-limiting manner with reference to the illustrated drawings, in which.

DESCRIPTION OF PREFERRED EMBODIMENTS

Figure 1:
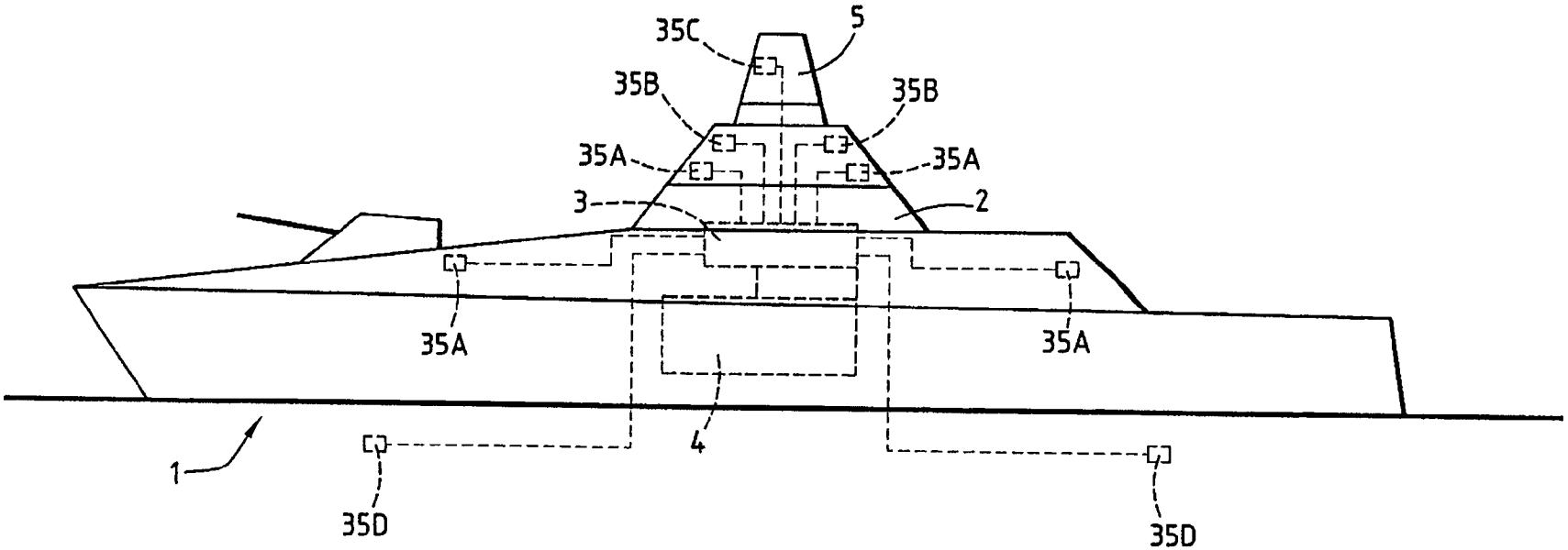
FIG. 1 is a schematic view of a ship for military use comprising a bridge, an operations control room and means for analysing the ship's environment.

The ship which is generally designated by 1 in FIG. 1 comprises, in a manner known per se, a control bridge 2 with a direct view of the ship's environment. The direct view is obtained via windows disposed on the front face of the bridge and on the rear face and optionally on the lateral sides of said bridge.

If the bridge comprises windows or glazed portions on all its faces, it allows 360° viewing of its environment.

The ship also comprises a room 3 for the operational control of its weapons system which is connected to means 4 for analysing the ship's environment. These means 4 for analysing the ship's environment consist of a specific number of devices known per se for computer analysis and display of information originating from sensors situated on the upper portion of the ship and in particular in the mast 5.

These sensors are conventionally radar, electromagnetic detection means, optical detection means or any other detection means with which a military ship can be equipped, as well as telecommunications means which receive information transmitted by means external to the ship.

The information is analysed in part automatically using computers and in part by operators who can transmit the information to the operations control room 3.

Figure 2:
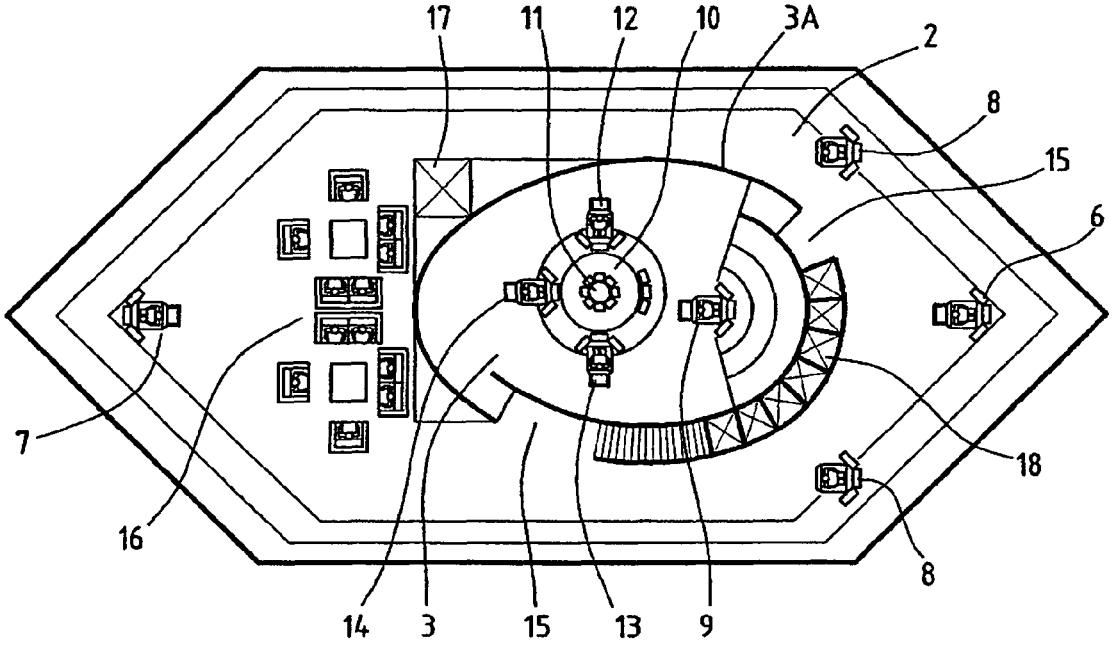
FIG. 2 is a schematic plan view of a ship's bridge comprising an operations control room for the ship.

As shown in FIG. 2, the operations control room 3 is set up inside the control bridge 2 and comprises direct accesses 15 which allow the operators to pass directly from the operations control room to the control bridge.

The control bridge comprises a plurality of steering posts which are, on the one hand, a direct steering post 6 situated toward the front of the control bridge, an aviation steering post 7 oriented toward the rear of the ship, with a direct view of the zone for manoeuvring of any on-board helicopters, and lateral steering posts 8 situated on the two sides of the bridge. The bridge also comprises a lounge 16 to allow the officers of the watch to rest. Access to the mast 17 and to the technical cabinets 18 arranged at the periphery of the operations control room is also provided.

The operations control room 3 of generally ovoid shape is referred to as a virtual reality and/or enhanced reality room of which the walls consist of screens on which a realistic representation of the ship's environment can be displayed by suitable known means. These walls which, for example, may be lined with liquid crystal screens or plasma screens constitute the panoramic display means 3A of the ship. A platform control and supervision post 9, on the one hand, and a table 10 comprising three posts arranged around a means for holographic display of the tactical situation 11, on the other hand, are arranged in the middle of the operations control room. These three posts are a post for monitoring protective and self-defense weapons 12, a post for monitoring superiority weapons 13 and a post for checking the entire operations control room 14.

All of these posts for controlling and supervising the platform for monitoring the protective and self defense weapons, for monitoring the superiority weapons, for checking all of the posts and the tactical situation three-dimensional holographic viewing device are supplied with information from the means 4 for analysing the ship's environment. Environment analysis means of this type as well as a holographic viewing device are known per se.

In addition, information about the entire environment of the ship is displayed on the peripheral screens in the room on a scale substantially equal to 1 so as to give a feeling of reality.

This information consists, in particular, of images which may be viewed from the ship's platform and which are provided by visible light viewing means. However, these images may also be images provided by night-time viewing means. The viewing means, whether in visible light or at night time, consist of cameras arranged at the periphery of the ship's bridge and/or optionally cameras arranged at the periphery of the ship's superstructure.

In addition, images issuing from means for detecting objects situated in the ship's environment, in particular moving objects such as other ships, such as aeroplanes, such as missiles, or even such as submarine objects such as torpedoes may be superimposed on the screens.

These images are prepared from information provided by the ship's detection means and are shaped by image processing means and by means for analysing the ship's environment. The images may be complemented by displays of information which can be used by operators to analyse the tactical situation. This information is, for example, information relating to the nature, the speed or the distance of objects situated around the ship.

The detection means are means which are known per se, which may be visible light cameras 35A optionally with light amplifiers and/or infrared cameras 35B allowing night vision arranged on the superstructures of the ship, radar 35C arranged in the mast 5, sonar 35D arranged on the hull below the water line. All this equipment transmits information to computer analysis means, in particular, which prepare images in realtime to represent, on the one hand, the images as seen and, on the other hand, the above-mentioned supplementary interpretation information.

These analysis means may represent only a portion of the aforementioned environment analysis means 4. They may possible necessitate the intervention of human operators to prepare some types of information.

In the embodiment just described, the operations control room 3 allows direct access to the bridge, and this has the advantage of allowing the operators and the officers acting in the operations control room to also intervene in the bridge, depending on the circumstances.

On the other hand, the environment analysis means 4 are separated and are situated inside the ship in a zone which is deeper in the structure of the ship and is protected from the environment. This arrangement allows a reduction in the workforce required to control the ship while maintaining the autonomy and independence of the environment analysis means.

Figure 3:
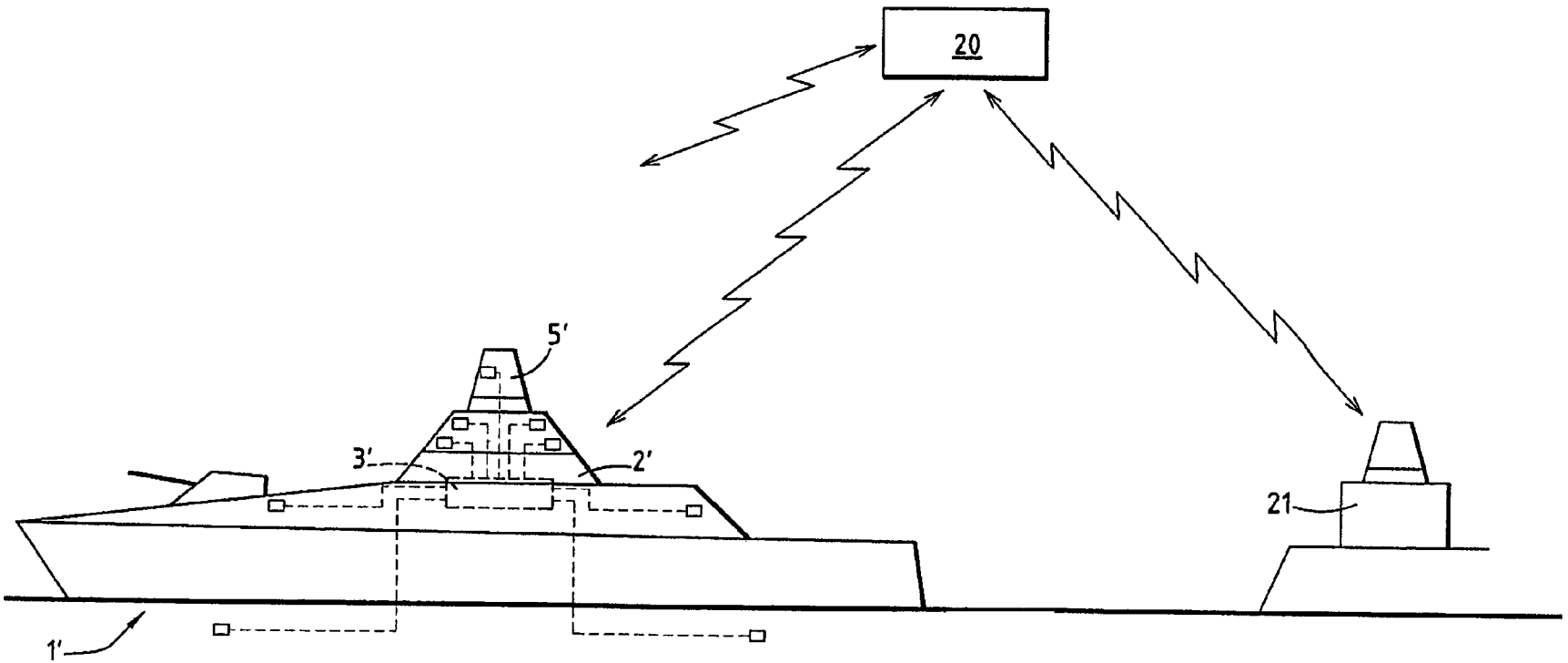
FIG. 3 is a schematic view of a ship of which the bridge comprises an operations control room communicating with means for analysing the ship's environment which are delocalised relative to the ship.

In a further embodiment, shown in FIG. 3, the ship 1' comprises a bridge 2' and an operations control room 3', which allows direct access to the control bridge 2'. The ship also comprises inherent detection and telecommunications means 5'. However, the ship is connected by external telecommunications means 20 which are, for example, a satellite with a tactical situation analysis post 21 which is, for example, situated on the land.

In this arrangement, the tactical situation analysis post 21, on the one hand, can receive information originating from other ships or other tactical situation supervision means such as supervision aircraft, satellites, submarine listening means, etc. and, on the other hand, can have very heavy means for shaping the analysis of the tactical situation.

With this arrangement, the information which is provided to the operators in the tactical control room 3' is prepared by tactical situation analysis means 21 and is transmitted via telecommunications means, in particular the satellite 20, to the ship. In this arrangement, on the one hand, the requirements of on-board tactical situation analysis means in the ship are substantially reduced and, on the other hand, an assembly of ships intervening in a grouped manner, for example a squadron, can receive coherent information from a single tactical situation analysis means.

In the embodiments just described, the tactical analysis means are situated in the ship or are situated on the land. However, these means can also be situated in an admiral ship of a squadron or in an assistance ship which has a specialised function in the analysis of the tactical situation, or finally may be arranged in an aircraft which is accompanying the ship.

The only requirement is to have, on the one hand, telecommunications means which allow information on an environment concerning the ship to be transmitted to the tactical analysis means and, on the other hand, telecommunications means which allow this information to be sent back to the ship in question. In all cases, finally, the ship has to comprise what is known as an "operational tactical" room provided with virtual reality and/or enhanced reality means.

In the embodiments just described, the ships are by definition military ships which receive information relating to their environment and concerning, on the one hand, the nature, position and actions of ally ships and, on the other hand, the nature and position of enemy ships, as well as information on aggressive moving objects which are travelling toward the ships, such as missiles, aircraft or torpedoes.

However, the virtual reality and/or enhanced reality means can be adapted to facilitate the piloting of ships in congested zones such as ports or offshore intervention zones in proximity to other ships or installations such as oil rigs. These means can significantly improve the safety conditions, in particular if visibility is greatly reduced owing to fog, the presence of smoke or the fact that it is night time.

A system of this type for analysing the ship's environment can also be used for civilian purposes. In particular, a tactical situation analysis means situated on the land can be, for example, a means for supervising a zone of intense circulation of merchant ships. This system can thus transmit, to each of the ships circulating in a zone, information which can be displayed in a tactical control room and which allows the operators to control the ship under better safety conditions, in particular when visibility is greatly reduced.

It should be emphasised that the operations control room equipped with means for the panoramic display of the ship's environment is distinct from the control bridge and is or can be physically separated from it. Generally the operations control room does not comprise windows or glazed bays allowing a direct view of the environment. If the operations control room comprises openings giving a direct view of the environment, this view is very limited. In all cases, the display means allow a realistic panoramic view of the environment via image display means such as screens. These means are adapted to allow control of the ship under safety conditions for navigation which are at least equal to those offered by the control bridge. These means can display means or information provided not only by cameras but also by radar, infrared sensors, sonar, electronic charts, etc.

It should also be emphasised that the operations control room according to the invention is intended not only to allow control of the ship without being in the control bridge but also other ship management and control functions. In particular, if the ship is a military ship, the operations control room is or may be intended for controlling the ship's weapons system and managing the internal safety of the ship, in particular the management of fire safety.

For controlling the weapons system, the operations control room receives information of a tactical nature provided by means for detecting objects and, in particular, aggressive objects, as well as information prepared by tactical analysis means which may be either human operators or computers equipped with appropriate software. These means are known to the person skilled in the art.

Generally, these means are situated out of the operations control room. But, some of these means can be situated in the operations control room, if necessary.

The person skilled in the art will understand that the information received by the operations control room can comprise information prepared by means situated on the ship and information prepared by means situated out of the ship.

Finally, to allow better cooperation between the various operators acting in the operations control room, operator posts equipped with screens comprising shared screen zones allowing display of supplementary information may be provided.

The invention claimed is:

1. A ship, comprising:

a control bridge with a direct view of an environment of the ship; and an operations control room configured to receive information in real time corresponding to a situation of the environment of the ship, the information prepared by analysis means for analyzing the environment of the ship, wherein the operations control room comprises panoramic display means for displaying a realistic panoramic display of a realistic representation of the environment of the ship.

2. The ship according to claim 1, wherein the panoramic display means extend to a periphery of the operations control room and are configured to display, in real time, images of the environment corresponding at least to what operators could see as if said operators had a direct view of the environment.

3. The ship according to claim 2, wherein the displayed images of the environment are prepared from images comprising images provided by viewing means for viewing in visible light.

4. The ship according to claim 2, wherein the displayed images are prepared from images comprising images provided by viewing means with night vision.

5. The ship according to claim 2, wherein the images from which the displayed images are prepared further comprise artificial images prepared from elements for analysing the environment.

6. The ship according to claim 5, wherein the artificial images are prepared in such a way as to allow identification and tracking of objects located in the environment.

7. The ship according to claim 6, wherein it is for military use and the identified objects are, in particular, aggressive objects.

8. The ship according to claim 2, further comprising:

viewing means and/or detection means; and processing means for preparing the images of the environment to be displayed in real time.

9. A ship, comprising:

a control bridge with a direct view of the an environment of the ship; and an operations control room configured to receive information in real time corresponding to a situation of the environment of the ship, the information prepared by analysis means for analyzing the environment of the ship, wherein the operations control room comprises panoramic display means for displaying a realistic panoramic display of a realistic representation of the environment, wherein the panoramic display means extend to a periphery of the operations control room and are configured to display, in real time, images of the environment corresponding at least to what operators could see as if said operators had a direct view of the environment, wherein the ship comprises viewing means and/or detection means, and processing means for preparing the images of the environment which are displayed in real time, and wherein the viewing and/or detection means comprise at least one device taken from at least one of a visible light camera, an infrared camera, radar, and sonar.

10. The ship according to claim 1, wherein the operations control room further comprises display means for displaying the situation of the environment prepared by the means for analyzing the environment.

11. The ship according to claim 10, wherein the means for displaying the situation of the environment comprise a three-dimensional holographic display bubble.

12. The ship according to claim 10, wherein the display means are adapted to create screen zones which are shared between a plurality of operators of the operations control room.

13. The ship according to claim 10, wherein it is for military use and the situation of the environment is a tactical situation.

14. The ship according to claim 1, wherein the operations control room comprises at least one direct access to the control bridge.

15. The ship according to claim 14, wherein the control bridge is configured to allow a direct view around 360°.

16. The ship according to claim 6, wherein the objects are moving objects.

17. The ship according to claim 9, wherein the visible light camera includes a light amplifier.

* * * * *